US008684572B2

(12) United States Patent
Weber

(10) Patent No.: US 8,684,572 B2
(45) Date of Patent: Apr. 1, 2014

(54) LED CONNECTOR ASSEMBLY

(75) Inventor: Ronald Martin Weber, Annville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 99 days.

(21) Appl. No.: 12/986,498

(22) Filed: Jan. 7, 2011

(65) Prior Publication Data

US 2012/0175653 A1 Jul. 12, 2012

(51) Int. Cl.
*F21V 5/04* (2006.01)

(52) U.S. Cl.
USPC ..... 362/507; 257/79; 257/99; 257/734; 257/718; 362/800

(58) Field of Classification Search
USPC ..... 362/507, 800, 549; 257/79, 99, 98, 734, 257/712, 718, 719, 720, E33.001
See application file for complete search history.

(56) References Cited

U.S. PATENT DOCUMENTS

| | | | | |
|---|---|---|---|---|
| 2006/0092659 | A1* | 5/2006 | Bynum | 362/549 |
| 2007/0171667 | A1* | 7/2007 | Watanabe et al. | 362/545 |
| 2007/0274086 | A1* | 11/2007 | Takeda et al. | 362/507 |
| 2009/0207617 | A1 | 8/2009 | Merchant et al. | |
| 2010/0072505 | A1 | 3/2010 | Gingrich | |

FOREIGN PATENT DOCUMENTS

| | | | |
|---|---|---|---|
| JP | 2003059332 | A | 2/2003 |
| WO | 2009104211 | A1 | 8/2009 |

OTHER PUBLICATIONS

International Search Report, International Application No. PCT/US2012/000005, International Filing Date, Apr. 1, 2012.

* cited by examiner

*Primary Examiner* — Michael Shingleton

(57) ABSTRACT

An LED connector assembly includes a housing having a cavity formed therein. A connector interface is positioned on the housing to receive electrical wiring from a power source. An LED package is provided having at least one LED die coupled thereto. The LED package is removably received in the cavity of the housing and retained using features in the LED package and housing. The LED package is electrically coupled to the connector interface to provide power to the at least one LED die.

20 Claims, 4 Drawing Sheets

LED CONNECTOR ASSEMBLY

BACKGROUND OF THE INVENTION

The subject matter described herein relates generally to an LED connector assembly.

LED assemblies are generally used in a significant number of lighting applications. For example, LED assemblies may be used for vehicle lighting, signs displays, industrial and commercial lighting, residential lighting, or the like. Generally, LED assemblies include at least one LED electrically coupled to a circuit board. The circuit board includes power traces extending therethrough to power the at least one LED. The at least one LED is typically soldered to the circuit board to provide an electrical connection with the power traces. The circuit board is retained within a housing that is positioned in the area to be illuminated. Alternatively, the circuit board may be positioned within a display.

However, conventional LED assemblies are not without their disadvantages. In particular, soldering an LED to circuit board increases the difficulty in replacing worn out LEDs. For example, if an LED breaks, short-circuits, or otherwise becomes damaged, the LED cannot be individually removed from the circuit board. Rather, the entire circuit board must be replaced, thereby increasing maintenance time and costs associated with replacing the LED. Current LED assemblies do not provide the ability to individually replace an LED such as one would replace an incandescent light bulb or the like.

A need remains for an LED connector assembly that provides a socket for receiving individual LED package and eliminates the need to solder the LED package to a circuit board.

SUMMARY OF THE INVENTION

In one embodiment, an LED connector assembly is provided. The LED connector assembly includes a housing having a cavity formed therein. A connector interface is positioned on the housing to receive electrical wiring from a power source. An LED package is provided having at least one LED die coupled thereto. The LED package is removably received in the cavity of the housing. The LED package is electrically coupled to the connector interface to provide power to the at least one LED die.

In another embodiment, an LED connector assembly is provided. The LED connector assembly includes an LED package having a latching surface formed therein. The LED package has at least one LED die joined thereto. A housing is provided that removably receives the LED package. The housing has a latch that engages the latching surface of the LED package to retain the LED package within the housing. The housing has an opening extending therethrough. The at least one LED die is positioned within the opening.

In another embodiment, an LED connector assembly is provided. The LED connector assembly includes a housing having a connector interface. The connector interface receives electrical wiring from a power source. A contact finger is coupled to the housing. The contact finger is electrically coupled to the connector interface. An LED package is provided having at least one LED die positioned thereon. The LED package includes a contact pad electrically coupled to the at least one LED die. The LED package is removably received within the housing so that the contact finger engages the contact pad to electrically couple the at least one LED die to the power source.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
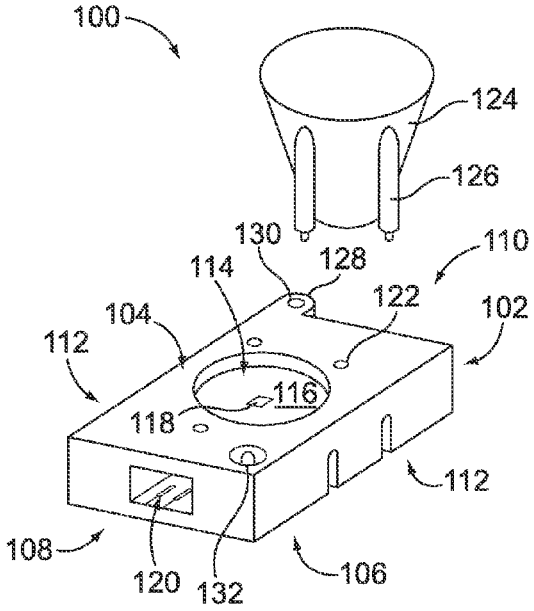
FIG. 1 is a top perspective view of an LED connector assembly formed in accordance with an embodiment.

FIG. 1 is a top perspective view of an LED connector assembly 100 formed in accordance with an embodiment. The LED connector assembly 100 includes a housing 102 having a top 104 and a bottom 106. The housing 102 includes a first end 108 and a second end 110. Sides 112 extend between the first end 108 and the second end 110. The top 104 of the housing 102 includes an opening 114 formed therein and extending through the housing 102. In the illustrated embodiment, the opening 114 is formed as a circle that is centered with respect to the housing 102. The opening 114 may have any size, shape, and location in alternative embodiments.

An LED package 116 is positioned within the housing 102. The LED package 116 includes at least one LED die 118 positioned thereon. The LED package 116 is positioned within the housing 102 so that the LED die 118 extends through the opening 114. The LED die 118 extends through the top 104 of the housing 102. In the illustrated embodiment, the LED package 116 is inserted through the bottom 106 of the housing 102. The LED package 116 is removably received within the housing 102. The LED package 116 may be removed from the housing 102 and replaced if the LED die 118 wears out and/or becomes damaged.

A connector interface 120 is positioned on the first end 108 of the housing 102. The connector interface 120 may be positioned on the second end 110 and/or one of the sides 112 of the housing 102 in alternative embodiments. The connector interface 120 receives electrical wiring (not shown) from a power source (not shown). In the illustrated embodiment, the connector interface 120 is a jack that receives a plug of a power cable. Optionally, the connector interface 120 may include a plug that is received in a jack. In other embodiment, the connector interface 120 may include any suitable wiring or connector to receive the electrical wiring from the power source. The connector interface 120 is electrically coupled to the LED package 116. The connector interface 120 provides power to the LED 118 so that the LED 118 is illuminated.

The housing 102 includes apertures 122 formed in the top 104 thereof. The apertures 122 are positioned around the opening 114 of the housing 102. The apertures 122 receive a lens 124. The lens 124 includes posts 126 that are received in the apertures 122 to couple the lens 124 to the housing 102. In alternative embodiments, the lens 124 and the housing 102 may include any suitable coupling mechanisms for joining the lens 124 to the housing 102. The lens 124 is positioned over the opening 114 in the housing 102. The lens 124 is aligned with the LED die 118 on the LED package 116. The lens 124 redirects light emitted from the LED die 118. In one embodiment, the lens 124 redirects the light emitted from the LED die 118 to focus the light.

The housing 102 includes a tab 128 extending from the second end 110 of the housing 102. The tab 128 includes an aperture 130 extending therethrough. The housing 102 also includes an aperture 132 positioned proximate to the first end 108 of the housing 102. The apertures 130 and 132 receive screws or the like to secure the housing 102 to a heat sink 180 (shown in FIG. 6). The housing 102 and the heat sink 180 may be secured to a wall, ceiling, within a lamp, or the like. In alternative embodiments, the apertures 130 and 132 may be positioned at any location along the housing 102. Optionally, the housing 102 may include any suitable coupling mechanism for being coupled to the heat sink 180.

Figure 2:
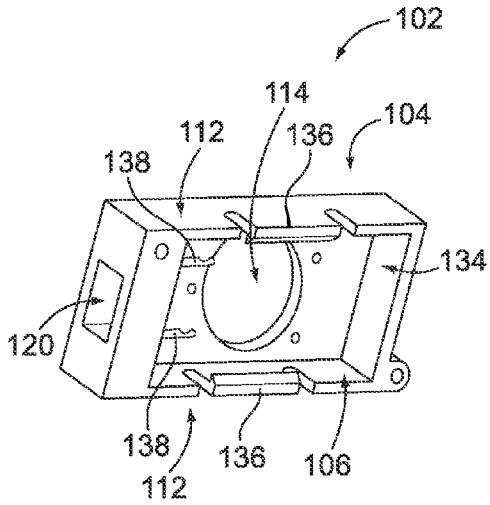
FIG. 2 is a bottom perspective view of a housing formed in accordance with an embodiment.

FIG. 2 is a bottom perspective view of the housing 102. The housing 102 has a cavity 134 formed therein. The cavity 134 extends through the bottom 106 of the housing 102. The opening 114 extends through the top 104 of the housing 102 and into the cavity 134. The cavity 134 receives the LED package 116 (shown in FIG. 1). The LED package 116 is inserted into the cavity 134 through the bottom 106 of the housing 102. The LED package 116 is retained within the cavity 134 so that the LED 118 emits light through the opening 114.

The housing 102 includes latches 136 formed on the sides 112 of the housing 102. The latches 136 engage the LED package 116 when the LED package 116 is inserted into the cavity 134. The latches 136 retain the LED package 116 within the cavity 134. The latches 136 are flexible to allow the LED package 116 to be snapped into the housing 102. The latches 136 may also be flexed outward to allow the LED package 116 to be removed from the housing 102. In alternative embodiments, the housing 102 may include latches 136 formed on the first end 108 and/or second end 110 of the housing 102. Optionally, the housing 102 may include any suitable coupling mechanisms for retaining the LED package 116 within the cavity 134.

Contact fingers 138 are positioned within the cavity 134. The contact fingers 138 extend from the connector interface 120 and into the cavity 134. The contact fingers 138 are electrically coupled to the connector interface 120. When the LED package 116 is positioned within the cavity 134, the contact fingers 138 engage the LED package 116. In the illustrated embodiment, the contact fingers 138 are formed as springs that provide contact with the LED package 116. Alternatively, the contact fingers 138 may be formed as any suitable electrical connectors. The contact fingers 138 carry power from the connector interface 120 to the LED package 116. The power provide to the LED package 116 to illuminate the LED die 118. The illustrated embodiment includes two contact fingers 138 to create a circuit through the LED connector assembly 100. Alternatively, the housing 102 may include any suitable number of contact fingers 138.

Figure 3:
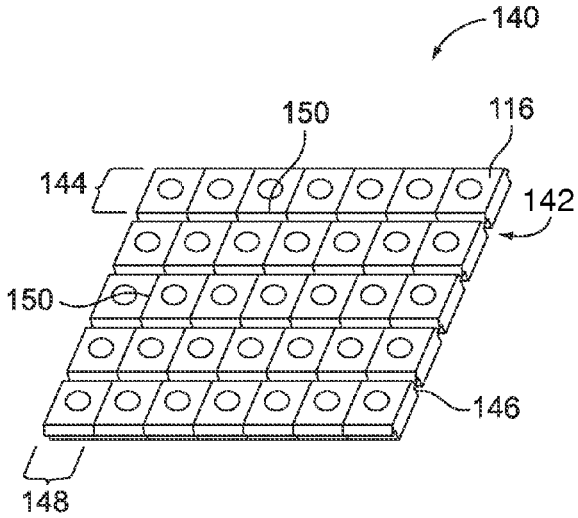
FIG. 3 is a top perspective view of an LED package array panel formed in accordance with an embodiment.

FIG. 3 is a top perspective view of an LED package array panel 140 formed in accordance with an embodiment. The LED package array panel 140 includes multiple LED packages 116 each of which contains at least one LED die 118. The multiple LED packages 116 are formed on the LED package array panel 140 as a single unit. The LED package array panel 140 may be coined, machined, or otherwise manufactured to form skive lines 142 throughout the panel 140. The skive lines 142 are formed between adjacent rows 144 of LED packages 116. The skive lines 142 are formed so that recesses 146 are created in each LED package 116. In one embodiment, the skive lines 142 may also be formed between adjacent columns 148 of LED packages 116.

The LED package array panel 140 is configured with break-away lines 150. The break-away lines 150 are coined, machined or otherwise manufactured between each adjacent LED package 116. The break-away lines 150 enable the individual LED packages 116 to be separated from the LED package array panel 140. When the individual LED packages 116 are separated from the LED package array panel 140, each LED package 116 has recesses 146 formed therein. The recesses 146 form latching surfaces 152 (shown in FIG. 5) in each LED package 116. The latching surfaces 152 provide a surface for latching the LED packages 116 into a housing 102.

Figure 4:
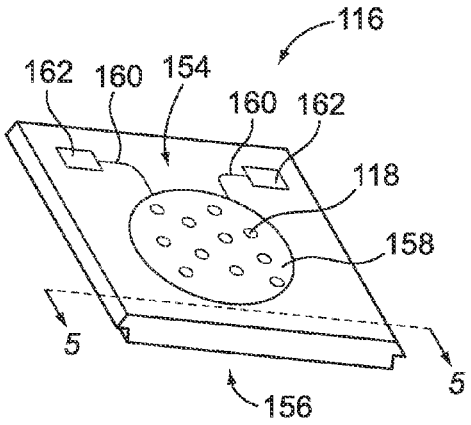
FIG. 4 is a top perspective view of an LED package removed from the LED package array panel shown in FIG. 1.

FIG. 4 is a top perspective view of an LED package 116. The LED package 116 includes a top 154 and a bottom 156. The top 154 of the LED package 116 has a diode surface 158 formed thereon. LED die 118 are electrically coupled to the diode surface 158. Power traces 160 extend from the diode surface 158. The power traces 160 may extend along a surface of the LED package 116 and/or be embedded within the LED package 116. The power traces 160 are joined contact pads 162 positioned on the surface of the LED package 116. The power traces 160 electrically couple the diode surface 158 and the contact pads 162.

When the LED package 116 is inserted into the housing 102 (shown in FIG. 2), the diode surface 158 is aligned with the opening 114 in the housing so that the LED die 118 emit light through the opening 114. The contact fingers 138 (shown in FIG. 2) engage the contact pads 162. The contact fingers 138 are configured as springs that press down on the contact pads 162. The contact fingers 138 are not required to be soldered or otherwise permanently coupled to the contact pads 162. Engagement of the contact pads 162 and the contact fingers 138 electrically couples the LED die 118 to the connector interface 120. Power supplied to the connector interface 120 is directed from the contact fingers 138 to the contact pads 162. The power then travels through the power traces 160 to the diode surface 158 to power the LED die 118. The power signal from the connector interface 120 provides power to the LED die 118 to illuminate the LED die 118.

Figure 5:
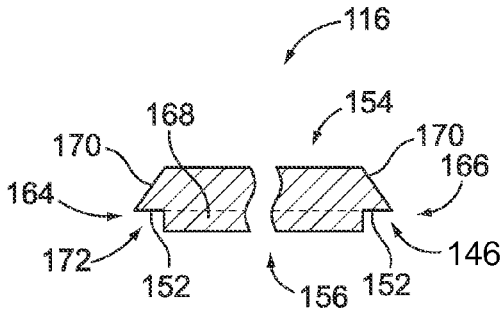
FIG. 5 is a side cross-sectional view of the LED package shown in FIG. 2.

FIG. 5 is a side cross-sectional view of the LED package 116 taken about line 5-5 shown in FIG. 4. The LED package 116 includes a first side 164 and a second side 166. The top 154 and the bottom 156 of the LED package 116 extend between the first side 164 and the second side 166. The LED package 116 includes a midline 168 positioned between the top 154 and the bottom 156. In the illustrated embodiment, the LED package 116 tapers inward from the midline 168 to the top 154 to form an engagement surface 170 which is formed by the break-away lines 150 (shown in FIG. 3). When the LED package 116 is inserted into the housing 102 (shown in FIG. 2), the engagement surfaces 170 slide along a corresponding latch 136 (shown in FIG. 2) to bow the latch 136 outward. The latch 136 bows outward to allow the LED package 116 to be received in the cavity 134 (shown in FIG. 2) of the housing 102.

The bottom 156 of the LED package 116 includes recesses 146 formed in each of the first side 164 and the second side 166. The recesses 146 extend between the bottom 156 and the midline 168 of the LED package 116. The recesses 146 extend from the first side 164 to the second side 166 partially through the LED package 116. The recesses 146 form the latching surfaces 152 of the LED package 116. When the LED package 116 is inserted into the housing 102 the latches 136 bow outward to allow the LED package 116 to be received within the cavity 134 of the housing 102. The latches 136 then snap back to a starting position so that the latches 136 engage the corresponding latching surfaces 152. The latches 136 engage the latching surfaces 152 to retain the LED package 116 within the cavity 134.

When an LED die 118 becomes damaged or otherwise unusable, the LED package 116 may be removed from the housing 102. The latches 136 of the housing 102 may be manually bowed outward so that the latches 136 become disengaged from the latching surfaces 152 of the LED package 116. The LED package 116 may then be removed from the bottom 106 (shown in FIG. 2) of the housing 102 and be replaced with a new LED package 116. Because the contact fingers 138 of the housing 102 are not permanently coupled to the contact pads 162 of the LED package 116, the LED package can be removed and replaced without disconnecting and/or rewiring connections between the housing 102 and the LED package 116.

Figure 6:
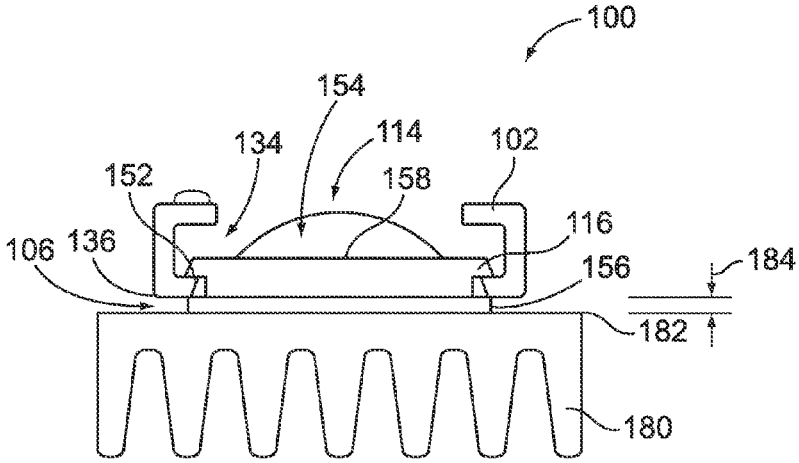
FIG. 6 is a side cross-sectional view of the LED connector assembly shown in FIG. 1 and joined to a heat sink.

FIG. 6 is a side cross-sectional view of the LED connector assembly 100 joined to a heat sink 180. The LED package 116 is positioned within the cavity 134 of the housing 102. The latches 136 of the housing 102 engage the latching surfaces 152 of the LED package 116 so that the LED package 116 is retained within the housing 102. The LED package 116 is positioned within the housing 102 so that the diode surface 158 is aligned with the opening 114 in the housing 102. The LED die 118 on the diode surface 158 are positioned to direct light through the opening 114.

In the illustrated embodiment, the top 154 of the LED package 116 is positioned within the housing 102. The housing 102 provides adequate normal force to the LED package to press it against the heat sink and ensure adequate thermal management. The bottom 156 of the LED package 116 extends from the bottom 106 of the housing 102. The bottom 156 of the LED package 116 is coupled to the heat sink 180. A thermal compound 182 is positioned between the bottom 156 of the LED package 116 and the heat sink 180. The thermal compound 182 transfers heat from the LED package 116 to the heat sink 180. The heat sink 180 absorbs the heat from the LED package 116 to cool the LED die 118. The heat sink 180 prevents overheating of the LED die 118, thereby reducing damage to and/or malfunctioning of the LED die 118.

The LED package 116 extends from the bottom 106 of the housing so that the LED package 116 can be joined to the heat sink 180 without creating contact between the housing 102 and the heat sink 180. A gap 184 extends between the housing 102 and the heat sink 180. The gap 184 ensures proper contact between the LED package 116 and the heat sink 180. The gap 184 ensures normal force will be transferred to the LED package 116 pressing it against the heat sink 180. This normal force provides for the proper thermal exchange between the LED package 116 and the heat sink 180. The gap 184 enables heat to be transferred between the LED package 116 and the heat sink 180 without heating the housing 102.

In the illustrated embodiment, the housing 102 is secured to the heat sink 180 with screws 186 that are received through the apertures 130 and 132 (both shown in FIG. 1) extending through the housing 102. Alternatively, the housing 102 may be joined to the heat sink 180 using any coupling mechanisms that provide the gap 184 between the housing 102 and the heat sink 180 and thereby ensure the normal force needed to press the LED package 116 against the heat sink 180.

Figure 7:
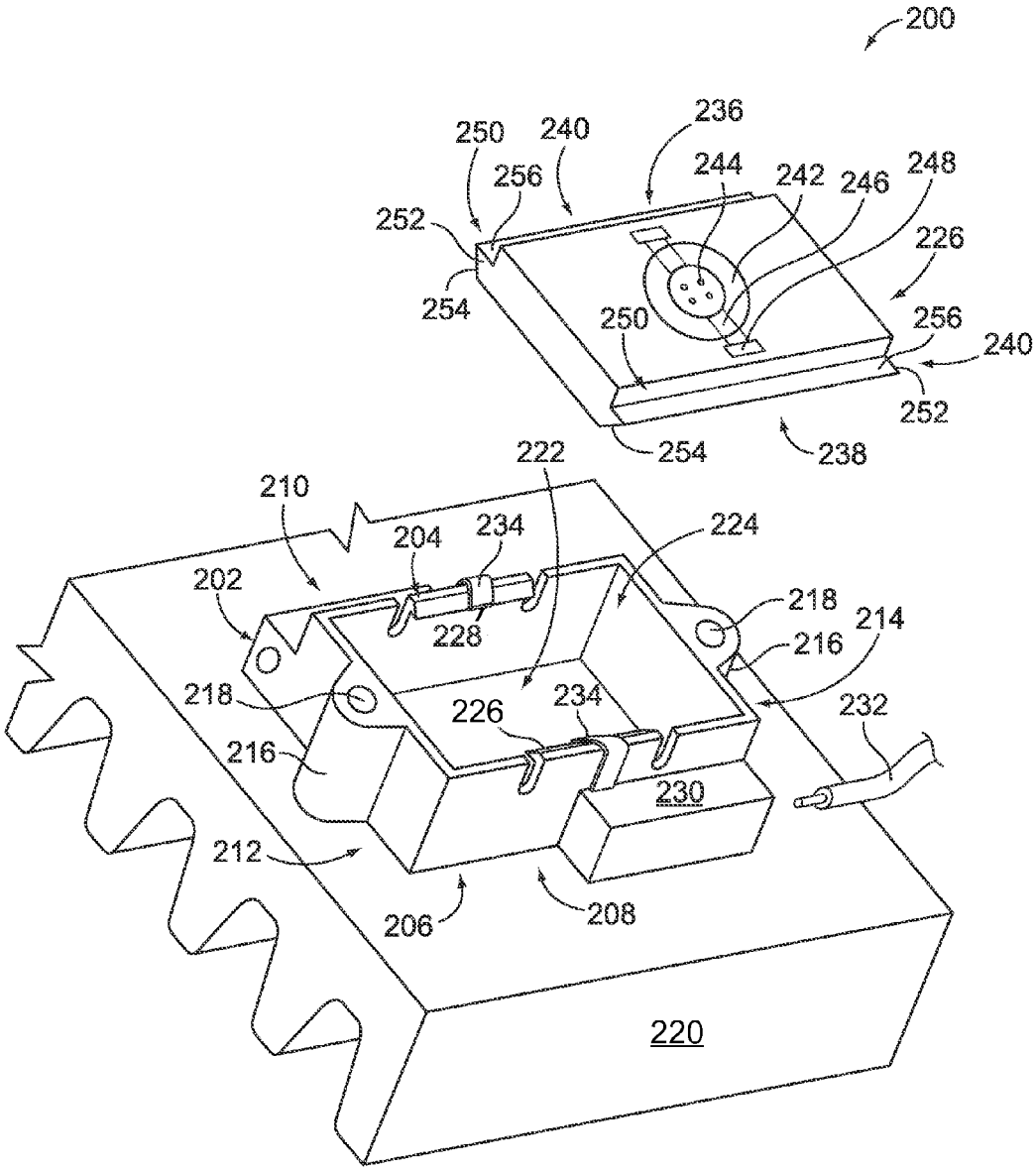
FIG. 7 is a top exploded view of an LED connector assembly formed in accordance with an alternative embodiment.

FIG. 7 is a top exploded view of an LED connector assembly 200 formed in accordance with an alternative embodiment. The LED connector assembly 200 includes a housing 202 having a top 204 and bottom 206. A first side 208 and a second side 210 extend between the top 204 and the bottom 206. A first end 212 and a second end 214 extend between the first side 208 and the second side 210. The first end 212 and the second 214 include flanges 216 having apertures 218 extending therethrough. The apertures 218 are configured to receive a screw or the like to secure the housing 202 to a heat sink 220. Alternatively, the housing 202 may include any suitable coupling mechanisms for securing the housing 202 to the heat sink 220.

A cavity 222 is defined by the housing 202. The cavity 222 extends between the first side 208 and the second side 210. The cavity 222 extends between the first end 212 and the second end 214. An opening 224 is formed in the top 204 of the housing 202. The cavity 222 extends from the opening 224 through the bottom 206 of the housing 202. The cavity 222 is configured to receive an LED package 226 therein. Latches 228 are formed in the first side 208 and the second side 210 of the housing 202. The latches 228 extend into the cavity 222. The latches 228 are configured to retain the LED package 226 within the cavity 222.

A connector interface 230 is coupled to the first side 208 of the housing 202. Optionally, the connector interface 230 may be positioned on the second side 210 of the housing 202 and/or at either of the first end 212 and/or the second end 214 of the housing 202. The connector interface 230 receives wiring 232 from a power source (not shown). The connector interface 230 directs power from the power source to the LED package 226 to power the LED package 226. The connector interface 230 may be formed as a plug and/or jack. Alternatively, the wiring 232 may be coupled directly to wires (not shown) in the connector interface 230. Contact fingers 234 extend from the connector interface 230. The contact fingers 234 extend into the cavity 222. The contact fingers 234 are configured to engage the LED package 226 to direct electrical signals from the connector interface 230 to the LED package 226. The illustrated embodiment includes a minimum of two contact fingers 234. One contact finger 234 extends from the first side 208 of the housing 202 and the other contact finger 234 extends from the second side 210 of the housing 202. Each contact finger 234 is positioned between a pair of latches 228. In alternative embodiments, the contact fingers 234 may extend from any portion of the housing 202.

The LED package 226 includes a top 236 and a bottom 238. Sides 240 extend between the top 236 and the bottom 238. A diode surface 242 is positioned on the top 236 of the LED package 226. The diode surface 242 includes LED die 244 electrically coupled thereto. Power traces 246 extend from the diode surface 242 to contact pads 248. The contact pads 248 are electrically coupled to the diode surface 242. When the LED package 226 is positioned within the housing 202, the contact fingers 234 engage the contact pads 248. The contact fingers 234 direct power signals between the connector interface 230 and the contact pads 248. The power traces 246 direct the power signals to the diode surface 242 to power the LED die 244. The connector interface 230 is electrically coupled to the LED die 244 so that connector interface 230 powers the LED die 244 with electrical signals from the power source.

The top 236 of the LED package 226 includes cutouts 250 extending along the sides 240 of the LED package 226. The cutouts 250 form flanges 252 along the bottom 238 of the LED package 226. The flanges 252 may extend the length of each side 240 of the LED package 226 or may extend along a shorter portion of each side. The flanges 252 include a tapered engagement surface 254 and a latching surface 256. The LED package 226 is inserted into the housing 202 from the top 204 of the housing 202. When the LED package 226 is inserted into the housing 202, the engagement surfaces 254 flare the latches 228 of the housing 202 outward so that the LED package 226 can be received within the cavity 222. When the LED package 226 is positioned within the cavity 222, the latches 228 snap back into a starting position so that the latches 228 engage the latching surfaces 256 of the LED package 226. The latches 228 engage the LED package 226 to retain the LED package 226 within the housing 202. In an exemplary embodiment, the LED package 226 is removably received within the housing 202. The latches 228 may be forced outward to release the LED package 226 from the cavity 222. Accordingly, the LED package 226 may be removed from the housing 202 and replaced.

When positioned in the housing 202, the top 236 of the LED package 226 is aligned with the opening 224 in the housing 202. The diode surface 242 is aligned with the opening 224 so that the LED die 244 extend through the opening 224. The LED die 244 are powered by the connector interface 230 to direct light therefrom. The light from the LED die 244 is directed from the top 204 of the housing 202. The light from the LED die 244 is directed through the opening 224 in the top 204 of the housing 202. In one embodiment, a lens (not shown) may be coupled to the top 204 of the housing 202 and/or to the top 236 of the LED package 226 to direct and/or focus the light emitted from the LED die 244.

The LED package 226 may be positioned within the housing 202 so that the bottom 238 of the LED package 226 extends from the bottom 206 of the housing 202. When the LED connector assembly 200 is positioned on the heat sink 220, the bottom 238 of the LED package 226 is positioned on the heat sink 220. The housing 202 is spaced from the heat sink 220 so that a gap (not shown) is formed between the housing 202 and the heat sink 220. The gap improves the ability of the heat sink 220 to draw heat from the LED package 226. In one embodiment, a thermal compound (not shown) is provided between the bottom 238 of the LED package 226 and the heat sink 220.

Figure 8:
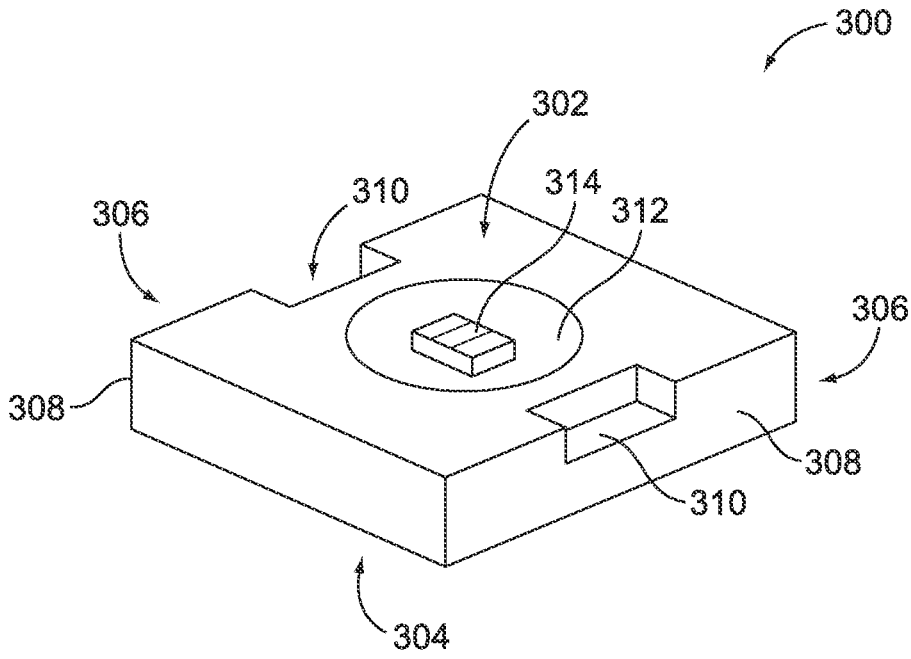
FIG. 8 is a top perspective view of an LED package formed in accordance with an alternative embodiment.

FIG. 8 is a top perspective view of an LED package 300 formed in accordance with an alternative embodiment. The LED package 300 includes a top 302 and a bottom 304. Sides 306 extend between the top 302 and the bottom 304. In the illustrated embodiment, the sides 306 flare outward from the bottom 304 to the top 302 of the LED package 300. The flared sides 306 form an engagement surface 308. The engagement surface 308 forces a pair of latches (not shown) outward when the LED package 300 is inserted into a housing (not shown).

Latching surfaces 310 are formed on each side 306 of the LED package 300. In an exemplary embodiment, the latching surfaces 310 are embossed into the sides 306 of the LED package 300. The latching surfaces 310 are centered along each side 306 of the LED package 300. The latching surfaces 310 are aligned with the engagement surfaces 308. In one embodiment, the latching surfaces 310 may be formed in any portion of the LED package 300. The latching surfaces 310 are formed to align with corresponding latches on the housing. When the LED package 300 is positioned within the housing, the latches of the housing snap back to a starting position. In the starting position, the latches engage the latching surfaces 310 of the LED package 300 to retain the LED package 300 within the housing.

The LED package 300 includes a diode surface 312 having LED die 314. When the LED package 300 is positioned within the housing, the LED die 314 are powered to direct light from the housing.

Figure 9:
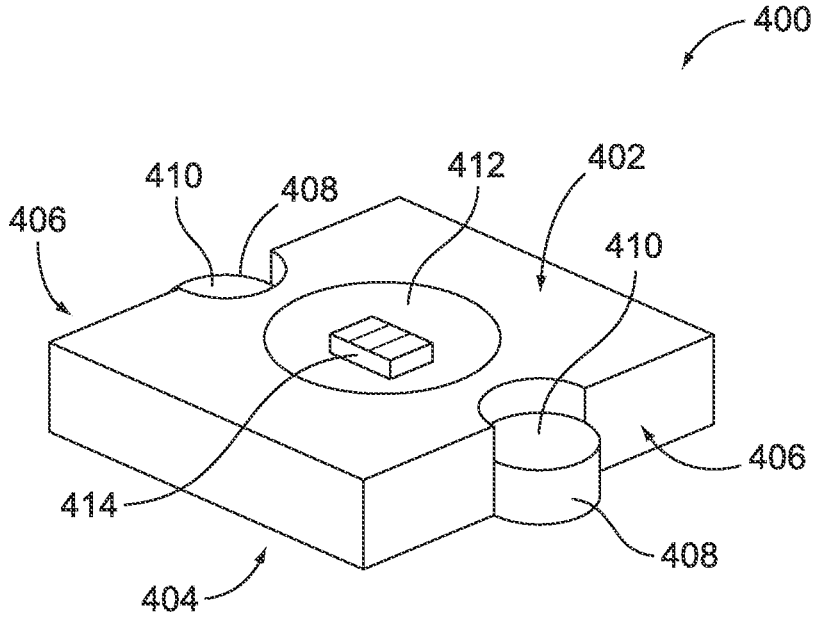
FIG. 9 is a top perspective view of an LED package formed in accordance with an alternative embodiment.

FIG. 9 is a top perspective view of an LED package 400 formed in accordance with an alternative embodiment. The LED package 400 includes a top 402 and a bottom 404. Sides 406 extend between the top 402 and the bottom 404. The sides 406 include tabs 408 extending therefrom. The tabs 408 may be cold-formed, cast into the LED package 400, embossed, or otherwise formed on the LED package 400. The tabs 408 are centered along the sides 406. Alternatively, the tabs 408 may be formed at any location of the LED package 400. The tabs 408 are positioned to align with corresponding latches (not shown) on a housing (now shown).

The tabs 408 form latching surfaces 410. The latching surfaces 410 are engaged by corresponding latches when the LED package 400 is inserted into the housing. The latches engage the latching surfaces 410 to retain the LED package 400 within the housing.

The LED package 400 includes a diode surface 412 having LED die 414. When the LED package 400 is positioned within the housing, the LED die 414 are powered to direct light from the housing.

It should be noted that in any of the embodiments described above, the LED packages and the housing may include any suitable coupling mechanisms to retain the LED package within the housing. Moreover, any of the embodiments described above may be modified so that the LED package is inserted into the housing from either the top and/or the bottom of the housing.

The embodiments described above provide a socketable LED connector assembly that enables an LED to be removed and replaced without removing and/or repairing a circuit board associated with the LED connector assembly. The LED assemblies described above may be used with any suitable lighting system, for example, household, commercial, and/or industrial lighting, signs and displays, vehicular lighting, or the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An LED connector assembly comprising:

a housing having a cavity formed therein, the housing having a top and a bottom, the cavity extending completely through from the top to the bottom of the housing;

a connector interface positioned on the housing to receive electrical wiring from a power source;

an LED package having at least one LED die coupled thereto, the LED package removably received in the cavity of the housing and retained by the housing in the cavity, wherein the at least one LED die is positioned such that light is emitted from the LED die through the top of the housing, the LED package electrically coupled to the connector interface to provide power to the at least one LED die, the LED package extending beyond the bottom of the housing wherein a bottom portion of the LED package is exposed beyond the bottom of the housing when the LED package is retained by the housing in the cavity.

2. The LED connector assembly of claim 1, wherein the housing includes a latch that couples to a latching surface formed on the LED package to retain the LED package within the cavity.

3. The LED connector assembly of claim 1 further comprising a contact finger extending from the connector interface into the cavity, the LED package including a contact pad electrically coupled to the LED die, the contact finger electrically engaging the contact pad.

4. The LED connector assembly of claim 1, wherein the housing includes an opening extending therethrough, the at least one LED die positioned within the opening when the LED package is received within the cavity.

5. The LED connector assembly of claim 1 further comprising a lens joined to the housing, the lens aligned with the at least one LED die to focus light emitted from the at least one LED die.

6. The LED connector assembly of claim 1 further comprising a heat sink joined to the bottom portion of the LED package, the LED package positioned on the heat sink so that a gap is formed between the housing and the heat sink with the housing and the heat sink not in direct contact with each other.

7. The LED connector assembly of claim 1, wherein the cavity is formed in the bottom of the housing, the LED package inserted into the housing from the bottom of the housing so that the at least one LED die is positioned within an opening in the top of the housing.

8. The LED connector assembly of claim 1, wherein the cavity is formed in the top of the housing, the LED package inserted into the housing from the top of the housing so that the at least one LED die is positioned within an opening in the top of the housing and oriented so that light from the LED package is directed through the opening in the top of the housing.

9. An LED connector assembly comprising:

an LED package having a latching surface formed therein, the LED package having at least one LED die joined thereto; and a housing that removably receives the LED package, the housing having a top and a bottom, wherein the at least one LED die is positioned such that light is emitted from the LED die through the top of the housing, the housing having a latch that engages the latching surface of the LED package to retain the LED package within the housing, the housing having an opening extending completely therethrough from the top to the bottom, the at least one LED die positioned within the opening and retained by the housing in the opening with a bottom portion of the LED package extending beyond the bottom of the housing, wherein the bottom portion of the LED package is exposed beyond the bottom of the housing when the LED package is retained by the housing in the opening.

10. The LED connector assembly of claim 9 further comprising a connector interface coupled to the housing, the connector interface receiving electrical wiring from a power source to power the at least one LED die.

11. The LED connector assembly of claim 9, wherein the LED package includes a contact pad electrically coupled to the at least one LED die, the contact pad engaging a power source positioned within the housing.

12. The LED connector assembly of claim 9, wherein the housing includes a contact finger electrically coupled to a power source, the contact finger engaging the LED package to provide power to the at least one LED die.

13. The LED connector assembly of claim 9, wherein the housing includes a cavity to receive the LED package, the opening extending from the cavity.

14. The LED connector assembly of claim 9 further comprising a heat sink joined to the bottom portion of the LED package, the LED package positioned on the heat sink so that a gap is formed between the housing and the heat sink with the housing and the heat sink not in direct contact with each other.

15. The LED connector assembly of claim 9, wherein the LED package is inserted into the housing from one of the top or bottom of the housing.

16. The LED connector assembly of claim 9 further comprising a lens joined to the housing, the lens aligned with the at least one LED die to focus light emitted from the at least one LED.

17. An LED connector assembly comprising:

a housing having a connector interface, the connector interface receiving electrical wiring from a power source, the housing having a top and a bottom and a cavity extending from the top completely through the bottom;

a contact finger coupled to the housing, the contact finger electrically coupled to the connector interface; and an LED package having at least one LED die positioned thereon, the LED package including a contact pad electrically coupled to the at least one LED die, the LED package removably received within the housing so that the contact finger engages the contact pad to electrically couple the at least one LED die to the power source, wherein the LED die is positioned such that light is emitted from the LED die through the top of the housing, the LED package retained by the housing with a bottom portion of the LED package extending beyond the bottom of the housing when the LED package is retained by the housing in the cavity, wherein the bottom portion of the LED package that extends beyond the bottom of the housing does not provide electrical power to the LED package.

18. The LED connector assembly of claim 17, wherein the housing includes a latch that couples to a latching surface formed on the LED package to retain the LED package within the housing.

19. The LED connector assembly of claim 17, wherein the housing includes a cavity to receive the LED package, the contact finger extending into the cavity.

20. The LED connector assembly of claim 17 further comprising a heat sink joined to the bottom portion of the LED package, the LED package positioned on the heat sink so that a gap is formed between the housing and the heat sink with the housing and the heat sink not in direct contact with each other.

* * * * *